US010537935B2

(12) United States Patent
Rollinger et al.

(10) Patent No.: US 10,537,935 B2
(45) Date of Patent: Jan. 21, 2020

(54) METHOD OF FORMING DUST-REMOVAL HOLES FOR A TURBINE BLADE, AND AN ASSOCIATED CERAMIC CORE

(71) Applicant: SAFRAN, Paris (FR)

(72) Inventors: Adrien Bernard Vincent Rollinger, Moissy-Cramayel (FR); Mirna Bechelany, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 16/077,171

(22) PCT Filed: Feb. 10, 2017

(86) PCT No.: PCT/FR2017/050310

§ 371 (c)(1),
(2) Date: Aug. 10, 2018

(87) PCT Pub. No.: WO2017/137709

PCT Pub. Date: Aug. 17, 2017

(65) Prior Publication Data

US 2019/0022743 A1 Jan. 24, 2019

(30) Foreign Application Priority Data

Feb. 12, 2016 (FR) ..... 16 51134

(51) Int. Cl.
*B22C 9/10* (2006.01)
*F01D 5/18* (2006.01)

(52) U.S. Cl.
CPC ..... *B22C 9/10* (2013.01); *F01D 5/187* (2013.01); *F05D 2230/211* (2013.01); *F05D 2260/607* (2013.01)

(58) Field of Classification Search
CPC ..... B22C 9/10; F01D 5/187
(Continued)

(56) References Cited

U.S. PATENT DOCUMENTS 9,890,644 B2 * 2/2018 Tran et al. ..... B22C 9/04
10,022,790 B2 * 7/2018 Lee et al. ..... B22C 7/02

FOREIGN PATENT DOCUMENTS

FR 2 961 552 A1 12/2011
FR 2 986 982 A1 8/2013
WO WO 2015/195110 A1 12/2015

OTHER PUBLICATIONS

International Preliminary Report on Patentability and the Written Opinion of the International Searching Authority as issued in International Application No. PCT/FR2017/050310, dated Aug. 14, 2018.

(Continued)

*Primary Examiner* — Kevin P Kerns
(74) *Attorney, Agent, or Firm* — Pillsbury Winthrop Shaw Pittman LLP

(57) ABSTRACT

A ceramic core used for fabricating a hollow turbine blade for a turbine engine using the lost wax casting technique, the blade including calibrated dust-removal holes emanating from a top of at least one cavity and opening out into a bathtub of the blade, wherein each of the calibrated dust-removal holes is formed in a core portion of height that is determined to be sufficient to guarantee mechanical strength, the core portion including a through orifice of axis perpendicular to a longitudinal axis of the calibrated dust-removal hole and defining on either side of the through orifice firstly a core cylinder having a determined diameter corresponding to the dust-removal hole that is to be formed, and secondly a remaining core volume that is to be plugged after casting, such that the calibrated dust-removal hole is obtained without drilling and without using connection rods.

7 Claims, 3 Drawing Sheets

(58) Field of Classification Search
USPC ..... 164/369
See application file for complete search history.

(56) References Cited

OTHER PUBLICATIONS

International Search Report as issued in International Application No. PCT/FR2017/050310, dated Jun. 27, 2017.

* cited by examiner

FIG.3
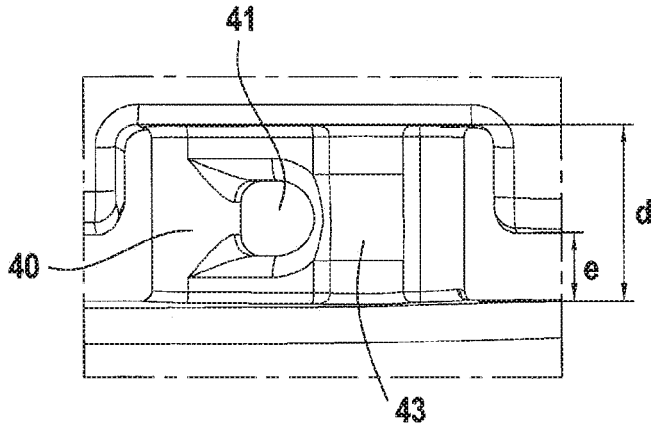
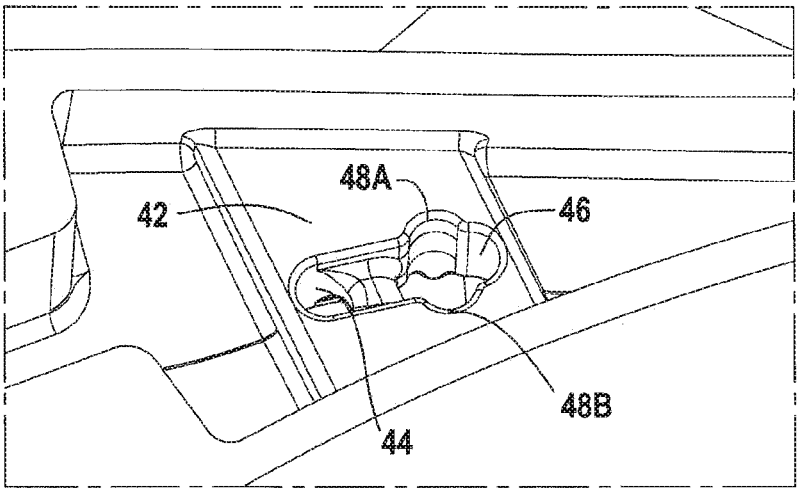
FIG.3A
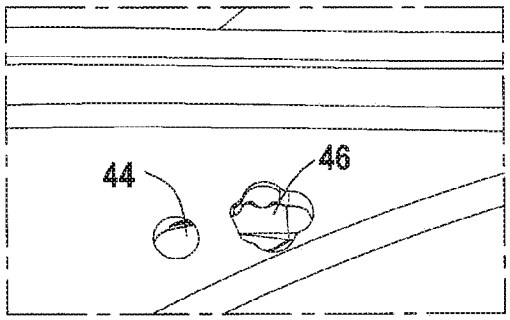
FIG.3B

METHOD OF FORMING DUST-REMOVAL HOLES FOR A TURBINE BLADE, AND AN ASSOCIATED CERAMIC CORE

CROSS-REFERENCE TO RELATED APPLICATIONS

This application is the U.S. National Stage of PCT/FR2017/050310 filed Feb. 10, 2017, which in turn claims priority to French patent application number 1651134 filed Feb. 12, 2016. The content of these applications are incorporated herein by reference in their entireties.

FIELD OF THE INVENTION

The present invention relates to the general field of sets of blades for a turbine engine turbine, and more particularly to turbine blades having cooling circuits incorporated therein made by the lost-wax casting technique.

PRIOR ART

In known manner, a turbine engine includes a combustion chamber in which air and fuel are mixed together prior to being burnt therein. The gas resulting from such combustion flows downstream from the combustion chamber and then feeds a high-pressure turbine and a low-pressure turbine. Each turbine comprises one or more rows of stationary vanes (referred to as nozzles) alternating with one or more rows of moving blades (referred to as rotor wheels), that are spaced apart circumferentially all around the rotor of the turbine. Such turbine blades and vanes are subjected to the very high temperatures of the combustion gas, which reach values well above those that can be withstood without damage by such blades or vanes that are in direct contact with such gas, which means that it is necessary to cool them continuously by means of an integrated cooling circuit that includes multiple cavities whenever it is desired to provide cooling that is effective and accurate without significantly increasing the flow rate of air and without penalizing the performance of the engine. The hollow blades formed in this way are fabricated by the so-called "lost wax" casting method that involves using a model part or core of outside surface that matches the inside surface of the finished blade, as described in application FR 2 961 552 filed in the name of the Applicant.

The air needed for operation of the engine generally contains various kinds of dust (in particular fine sand) that can accumulate in the cooling circuits of turbine blades thereby leading to the discharge orifices at the outlets from the cavities becoming closed, and thus threatening the integrity of the blades. In order to mitigate that problem, turbine blades are fitted at the tops of their cavities with calibrated dust-removal holes that are obtained by high precision machining or by means of connection rods made of alumina or of quartz, which are inserted in the ceramic core, and which serve, by being knocked-out (i.e. by being dissolved), to generate these holes so as to guarantee that such particles are discharged.

Nevertheless, using such connection rods raises certain problems. Firstly, alumina rods are very difficult to eliminate with basic solutions (or under standard knock-out conditions for ceramic cores), requiring longer reaction times, very high concentrations of sodium hydroxide or of potassium hydroxide, and very high temperatures and pressures that can be aggressive for the alloy (corrosion under stress). Likewise, quartz rods present low mechanical strength, which penalizes their use in a lost wax casting method in which the core is subjected to various mechanical stresses since it possesses a different coefficient of thermal expansion (CTE) and is also often of different composition. Furthermore, the use of rods is not applicable in all methods of fabricating cores. For example, with cores prepared by additive manufacturing or cores obtained by machining a ceramic block, the rods cannot be embedded in the core during fabrication (unlike fabrication by the injection molding method). Finally, the use of rods is not applicable to all geometrical shapes of core, in particular those involving thin plates of shape to which the rods must fit closely.

Also, since a plurality of ceramic cores are generally assembled together via the roots and the tips of the cores (non-functional core portions), excess material resulting from casting (a consequence of assembling the cores together) needs to be eliminated when machining the outer air seal or "bathtub", thereby making it necessary to have recourse to various techniques for surfacing (plugging) or for brazing plates. Unfortunately, such brazed plates are not robust (they can become detached and it may thus be necessary to thicken them locally) and surfacing is often not accurate (plugging depth uncertain). Under such circumstances, it is found to be particularly difficult to drill connection rods forming the dust-removal holes since such calibrated drilling takes place in a location that has previously been plugged, and that therefore has a smaller diameter while nevertheless complying with the specified minimum diameter for discharging debris. Application US2010/303625 illustrates such drilling of ceramic rods by electrical discharge machining (EDM).

OBJECT AND SUMMARY OF THE INVENTION

The present invention thus seeks to mitigate the above-mentioned drawbacks by proposing a geometrical arrangement of the core making it simple to obtain dust-removal holes in a manner that is more reliable than at present, and in particular without making the core less robust. Another object is to eliminate the final operation in the prior art of drilling the bathtub in order to obtain such orifices.

For this purpose, there is provided a ceramic core used for fabricating a hollow turbine blade for a turbine engine by using the lost wax casting technique, said blade including calibrated dust-removal holes emanating from a top of at least one cavity and opening out into a bathtub of said blade, the core being characterized in that each of said calibrated dust-removal holes is formed in a core portion of height that is determined to be sufficient to guarantee mechanical strength, said core portion including a through orifice of axis perpendicular to a longitudinal axis of said calibrated dust-removal hole and defining on either side of said through orifice firstly a core cylinder having a determined diameter corresponding to said dust-removal hole that is to be formed, and secondly a remaining core volume that is to be plugged after casting, such that said calibrated dust-removal hole is obtained without drilling and without using connection rods.

Thus, the dust-removal holes may be obtained directly from casting by injection, additive manufacturing, or machining ceramic cores, without drilling and without using connection rods. Any potential source of differential thermal expansion is eliminated, the mechanical strength of the core is improved, and correspondingly the mechanical properties of the blade are thus maintained. This core also serves to eliminate the prior art operation of machining that needs to take account of restricting uncertainties and that can have a harmful impact on the geometrical shape of the plates of a multi-cavity circuit.

Depending on the intended embodiment, said core portion may form a portion of a side column that is to create a side cavity of said blade or an inter-cavity connection zone between said at least one cavity and said bathtub.

Preferably, on a core portion corresponding to said bathtub that is to be created, there is provided a setback zone for enabling said through orifice to be centered in said connection zone, so as to guarantee better strength for said core portion during casting.

Advantageously, when the dimensions of the blade make this necessary, said remaining core volume includes at least one lateral stiffener (or two stiffeners giving it a four-lobed shape) of dimensions suitable for guaranteeing better strength for said core portion during casting.

The invention also provides a method of forming calibrated dust-removal holes in a hollow turbine blade of a turbine engine made using the lost wax casting technique by means of a ceramic core as explained above, and any turbine engine turbine including a plurality of cooled blades fabricated using such a method.

BRIEF DESCRIPTION OF THE DRAWINGS

Other characteristics and advantages of the present invention appear from the following description made with reference to the accompanying drawings, which show an implementation having no limiting character, and in which:

FIG. 3 is a view of a portion of the FIG. 1 core showing a connection with the bathtub; and FIGS. 3A and 3B are views respectively after casting and after machining once the FIG. 3 core portion has been removed.

DETAILED DESCRIPTION OF AN EMBODIMENT

Figure 1:
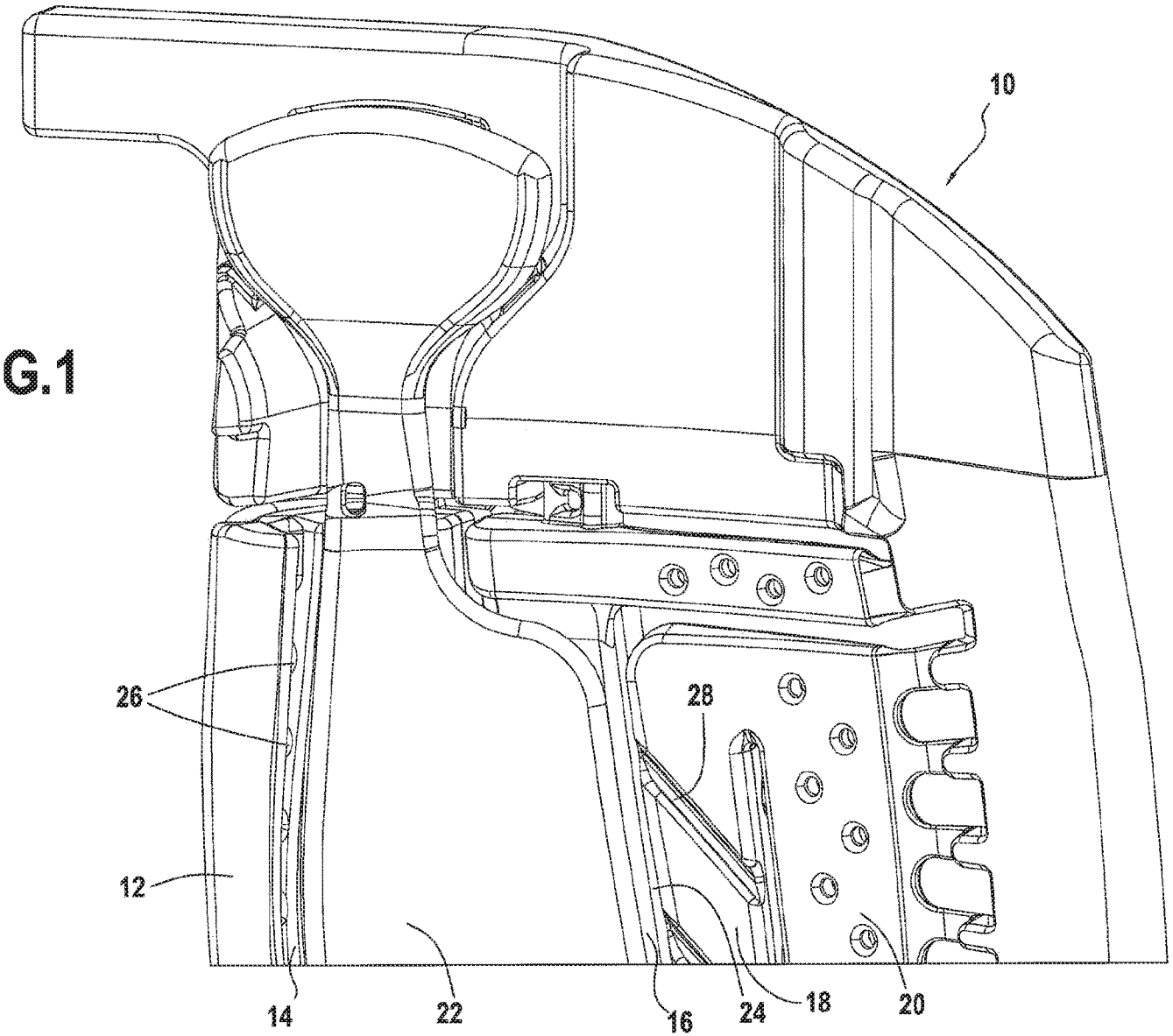
FIG. 1 is a fragmentary view of a turbine blade core of the invention.

FIG. 1 shows, the tip assembly of a ceramic core for use in making a hollow turbine blade of a turbine engine. In the example shown, the ceramic core 10 comprises seven portions or columns. The first column 12, which is to be located on the side where the combustion gas arrives, corresponds to a leading edge cavity that is to be created after casting, whereas the second column 14 corresponds to a central cavity that is adjacent thereto. This cavity receives a stream of cooling air via a channel that results, after casting, from the presence of a first column root of the core. Three other columns 16, 18, and 20 correspond to adjacent cavities that receive a second stream of cooling air via another channel coming from the presence of a second column root of the core. Finally, the core also has sixth and seventh columns 22 and 24 constituting side columns and corresponding to side cavities created after casting, being respectively spaced apart from the second and third columns 14 and 16 by a determined spacing needed for creating a solid inter-cavity wall when casting the molten metal.

The first and second columns 12 and 14 are connected to each other by a series of bridges 26 that correspond, after casting, to air feed orifices for cooling the leading edge cavity. For the fourth column 18, other bridges 28 that are vertically inclined by forming thinned regions of the core serve to create stiffened regions of the blade. The sizes of the various bridges are determined to ensure that they do not break while the core 10 is being handled, since that would make the core unusable. In the example under consideration, the bridges are distributed so as to be substantially regularly spaced apart over the height of the core, in particular close to the first column of the core.

In accordance with the invention, the turbine blade dust-removal holes needed for removing any dust (in particular fine sand) that might accumulate in the cooling circuits are obtained by a geometrical arrangement for a portion of the core as a direct result of casting, without drilling and without using connection rods, whether in the form of holes present in the side cavities of the core or holes providing a connection with the bathtub. Although the core as formed in this way differs from prior art cores, the method of making the blade by lost wax casting after the core has been made is conventional and consists initially in forming an injection mold in which the core is placed prior to injecting the wax. The wax model as created in that way is then dipped in slurries constituted by a suspension of ceramic in order to make a casting mold (also referred to as a "shell" mold). Finally, the wax is eliminated and the shell mold is fired in a kiln, after which molten metal can then be cast into the mold. Final machining (nevertheless simplified compared with prior art machining) as described in greater detail below then enables the finished blade to be obtained.

Figure 2:
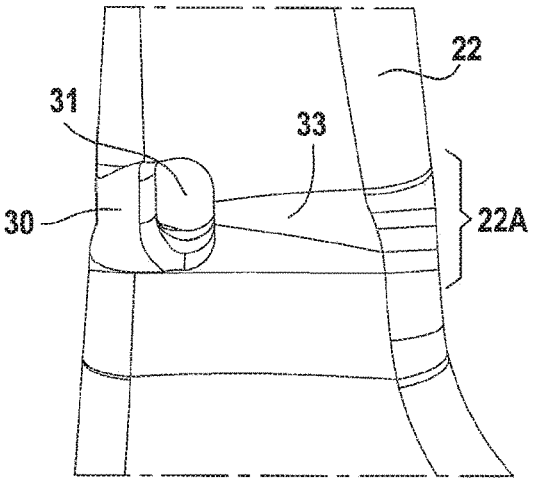
FIG. 2 is a view of a portion of the FIG. 1 core showing a side plate.

According to the invention, and as shown in FIG. 2, provision is made in the portion 22A of the core to provide a local geometrical arrangement of the side columns 22, 24 (ceramic core portions giving rise to the side cavities) so as to form firstly a core cylinder 30 of determined diameter (calibrated to be about 0.5 millimeters (mm) to 0.8 mm) corresponding to the dust-removal hole that is to be made, and also of height that is as small as possible so as to guarantee the mechanical strength of the plate, and also a core volume 33 corresponding to the remaining space of the core and that is to be plugged after casting. This shape may be obtained in conventional manner by incorporating a bridge type disturber in the mold of the plate (at a through orifice 31 having a longitudinal axis defining the cylinder 30 and the remaining volume 33 in a direction perpendicular to the axis) if ceramic injection is used or without additional constraint if additive manufacturing or core machining are used.

When made necessary by the dimensioning of the turbine blade, and given the fragile nature of the ceramic, it is appropriate to guarantee mechanical strength for the core by ensuring that the plates obtained after casting are not mechanically weakened, e.g. by stiffening them by adding one or more stiffeners so as to prevent the plates from breaking in those locations. It should be observed that such lateral stiffeners (illustrated by reference 39 in FIG. 2B) have very little impact on injection (the overall section does not vary excessively, with the portion lost with the drilling being compensated by adding the stiffener).

Likewise, since ceramic cores made by injection need to be unmolded, it is clearly necessary to ensure that such cores present sufficient taper relative to a technical unmolding axis. Specifically, if the unmolding axis is not well oriented, the plate can be greatly weakened.

Figure 2A:
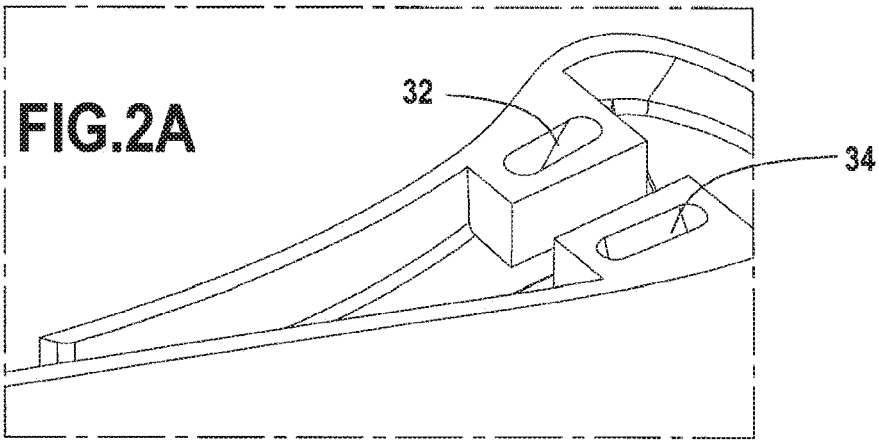
FIGS. 2A and 2B are views respectively after casting and after machining once the FIG. 2 core portion has been removed.
Figure 2B:
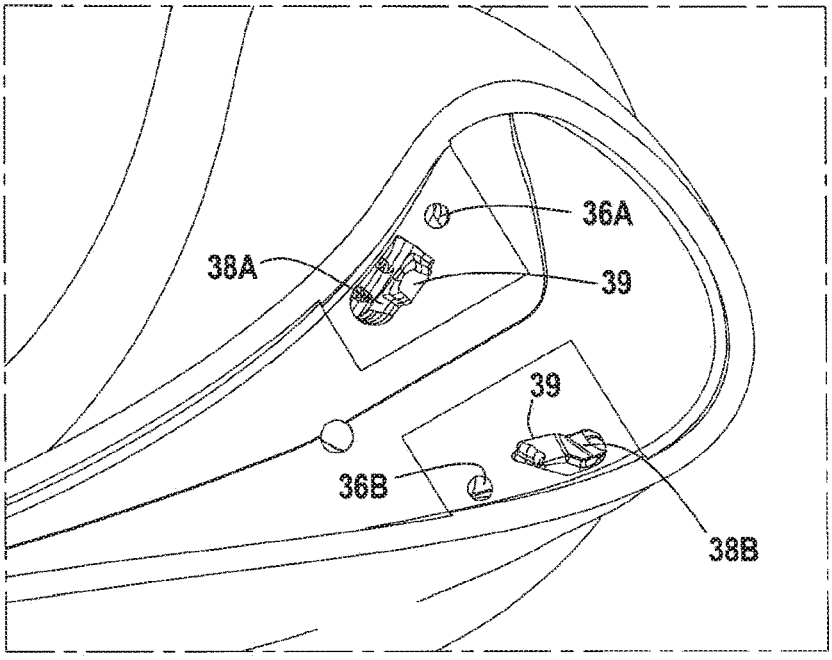

FIG. 2A shows the top portion of the blade (its bathtub) obtained at the end of casting (rough casting) with the two cavities 32 and 34 corresponding to the two side columns and the excess material that surrounds them resulting from assembling those columns. In FIG. 2B, there can be seen the same bathtub after the excess material has been machined, and it can be seen that with the invention two holes 36A, 38A; 36B, 38B are formed in each cavity (instead of only one as in the prior art). One of the holes 36A, 36B, having the size of the core cylinder 30, is to perform the dust-removal function, while the other hole 38A, 38B, which does not have any particular function and which has the size of the volume of the remaining core 33, is to be plugged. Thus, the invention eliminates the operation of plugging/drilling the dust-removal hole, which in the prior art is the operation that is the most difficult and that presents the least robustness. The problem that exists in the prior art of the uncertain depth of the plugging no longer impedes proper making of the bathtub, since there is no longer any need to drill the bathtub.

The connection with the bathtub is shown in FIG. 3. As for the side plates, in order to obtain a dust-removal hole, a local geometrical arrangement is provided for connection purposes by forming on either side of the through orifice 41 firstly a core cylinder 40 of determined diameter corresponding to the diameter of the dust removal hole that is to be made, and secondly the remaining volume of the core 43 that is to be plugged after casting. The core cylinder also presents a height that is as small as possible in order to guarantee good strength for the core and avoid cracks forming. As before, the through orifice may be formed by using a disturber of bridge type integrated in the casting mold. Nevertheless, since the available space e between the cavities and the bathtub is very small, and since the inter-cavity connection is thin (and thus of small section), provision is also made to arrange a setback zone on a portion of the core where the bathtub is to be created, thus making it possible to obtain a space d that is larger. Furthermore, since the through orifice 41 that is to receive the disturber is thus centered on the inter-cavity connection, better robustness is thus obtained during casting.

FIG. 3A shows the top portion of the blade (bathtub) that is obtained at the end of casting (rough casting) with the raised land 42 results from setting back the core through the space d. In FIG. 3B, there can be seen the same bathtub of this raised land after machining, and it can be seen that with the invention two holes 44 and 46 are formed in the bathtub. It should be observed that two lateral stiffeners 48A, 48B are present, giving the second hole (corresponding to a section of the volume 43) a four-lobed shape, which stiffeners are of dimensions suitable for guaranteeing that the core is robust. When using ceramic injection, this also makes it possible to increase the section and to guarantee better filling, and when using additive manufacturing and core machining, the stiffeners stiffen the connection and prevent the cores from deforming.

Naturally, as mentioned above, when using ceramic injection, it is necessary for the core to remain un-moldable, so the added connection must also be un-moldable, as must the hole made therein.

With the invention, means are thus proposed for combining the functions of holding the core and of preparing dust-removal holes (a function that is usually performed by rods), which means can be applied to any type of core fabrication method and to any type of geometrical shape for the core.

The invention claimed is:

1. A ceramic core used for fabricating a hollow turbine blade for a turbine engine using a lost wax casting technique, said blade including a plurality of calibrated dust-removal holes emanating from a top of at least one cavity and opening out into a bathtub of said blade, wherein each calibrated dust-removal hole of said plurality of calibrated dust-removal holes is formed in a core portion of height that is determined to guarantee mechanical strength, said core portion including a through orifice of axis perpendicular to a longitudinal axis of said calibrated dust-removal hole and defining on either side of said through orifice firstly a core cylinder having a determined diameter corresponding to said calibrated dust-removal hole that is to be formed, and secondly a remaining core volume that is to be plugged, after casting, such that said calibrated dust-removal hole is obtained without drilling and without using connection rods.

2. The ceramic core according to claim 1, wherein said core portion forms a portion of a side column that is to create a side cavity of said blade.

3. The ceramic core according to claim 2, wherein said remaining core volume includes at least one lateral stiffener of dimensions suitable for guaranteeing better strength for said core portion during casting.

4. The ceramic core according to claim 3, wherein said remaining core volume includes two lateral stiffeners facing each other and giving said remaining core volume a four-lobed shape.

5. The ceramic core according to claim 1, wherein said core portion forms an inter-cavity connection zone between said at least one cavity and said bathtub.

6. The ceramic core according to claim 5, comprising, on a core portion corresponding to said bathtub that is to be created, a setback zone for enabling said through orifice to be centered in said connection zone, so as to guarantee better strength for said core portion during casting.

7. The ceramic core according to claim 5, wherein said remaining core volume includes at least one lateral stiffener of dimensions suitable for guaranteeing better strength for said core portion during casting.

* * * * *